US007777427B2

(12) United States Patent
Stalker, III

(10) Patent No.: US 7,777,427 B2
(45) Date of Patent: Aug. 17, 2010

(54) METHODS AND APPARATUS FOR IMPLEMENTING POWER CYCLE CONTROL OF LIGHTING DEVICES BASED ON NETWORK PROTOCOLS

(75) Inventor: John C. Stalker, III, Wilmington, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 1107 days.

(21) Appl. No.: 11/422,589

(22) Filed: Jun. 6, 2006

(65) Prior Publication Data

US 2006/0273741 A1 Dec. 7, 2006

Related U.S. Application Data

(60) Provisional application No. 60/687,772, filed on Jun. 6, 2005.

(51) Int. Cl.
*H05B 37/02* (2006.01)

(52) U.S. Cl. ..... 315/291; 315/307

(58) Field of Classification Search ..... 315/149, 315/224, 291, 307, 112, 113, 118, 150, 308; 362/249.02, 458, 800
See application file for complete search history.

(56) References Cited

U.S. PATENT DOCUMENTS 5,350,977 A * 9/1994 Hamamoto et al. ..... 315/291
6,016,038 A 1/2000 Mueller et al.
6,150,774 A 11/2000 Mueller et al.
6,166,496 A 12/2000 Lys et al.
6,211,626 B1 4/2001 Lys et al.
6,292,901 B1 9/2001 Lys et al.
6,340,868 B1 1/2002 Lys et al.
6,441,558 B1 * 8/2002 Muthu et al. ..... 315/149
6,459,919 B1 10/2002 Lys et al.
6,507,159 B2 * 1/2003 Muthu ..... 315/307
6,528,954 B1 3/2003 Lys et al.
6,548,967 B1 4/2003 Dowling et al.
6,577,080 B2 6/2003 Lys et al.
6,608,453 B2 8/2003 Morgan et al.
6,624,597 B2 9/2003 Dowling et al.
6,717,376 B2 4/2004 Lys et al.
6,720,745 B2 4/2004 Mueller et al.
6,774,584 B2 8/2004 Lys et al.

(Continued)

FOREIGN PATENT DOCUMENTS

DE 29706523 U1 9/1998

(Continued)

*Primary Examiner*—Douglas W Owens
*Assistant Examiner*—Jimmy T Vu

(57) ABSTRACT

A controllable dimmer/relay used in combination with a power cycle control lighting device, wherein the controllable dimmer/relay serves as a network interface for the power cycle control lighting device. The controllable dimmer/relay is controlled by lighting commands formatted according to any of a variety of communications protocols, which instruct the controllable dimmer/relay to output one or more power cycles (interruptions in power) rather than gradual increases or decreases in power. In response to the power cycle(s) output by the controllable dimmer/relay, the power cycle control lighting device alters some aspect of the generated light (e.g., change one or more of color, color temperature, overall brightness, dynamic effect, etc.). In this manner, a power cycle control lighting device may be made responsive, via the controllable dimmer/relay, to lighting control commands formatted according to any of a variety of industry standard (e.g., DMX, Ethernet, DALI, X10) or proprietary protocols.

33 Claims, 3 Drawing Sheets

U.S. PATENT DOCUMENTS

| | | | | |
|---|---|---|---|---|
| 6,777,891 | B2 | 8/2004 | Lys et al. | |
| 6,781,329 | B2 | 8/2004 | Morgan et al. | |
| 6,788,011 | B2 | 9/2004 | Mueller et al. | |
| 6,801,003 | B2 | 10/2004 | Schanberger et al. | |
| 6,806,659 | B1 | 10/2004 | Mueller et al. | |
| 6,815,842 | B2 * | 11/2004 | Fehd et al. | 307/40 |
| 6,883,929 | B2 | 4/2005 | Dowling | |
| 6,888,322 | B2 | 5/2005 | Dowling et al. | |
| 6,897,624 | B2 | 5/2005 | Ducharme et al. | |
| 6,936,978 | B2 | 8/2005 | Morgan et al. | |
| 6,965,205 | B2 | 11/2005 | Piepgras et al. | |
| 6,967,448 | B2 | 11/2005 | Morgan et al. | |
| 6,969,954 | B2 | 11/2005 | Lys | |
| 6,975,079 | B2 | 12/2005 | Lys et al. | |
| 7,031,920 | B2 | 4/2006 | Dowling et al. | |
| 7,038,398 | B1 | 5/2006 | Lys et al. | |
| 7,038,399 | B2 | 5/2006 | Lys et al. | |
| 7,042,172 | B2 | 5/2006 | Dowling et al. | |
| 7,405,715 | B2 * | 7/2008 | Guzman et al. | 345/83 |
| 7,502,034 | B2 * | 3/2009 | Chemel et al. | 345/594 |
| 2002/0033680 | A1 | 3/2002 | Fehd et al. | |
| 2002/0038157 | A1 | 3/2002 | Dowling et al. | |
| 2002/0048169 | A1 | 4/2002 | Dowling et al. | |
| 2002/0070688 | A1 | 6/2002 | Dowling et al. | |
| 2002/0074559 | A1 | 6/2002 | Dowling et al. | |
| 2002/0078221 | A1 | 6/2002 | Blackwell et al. | |
| 2002/0130627 | A1 | 9/2002 | Dowling et al. | |
| 2002/0145394 | A1 | 10/2002 | Morgan et al. | |
| 2002/0145869 | A1 | 10/2002 | Dowling | |
| 2002/0152045 | A1 | 10/2002 | Dowling et al. | |
| 2002/0158583 | A1 | 10/2002 | Lys et al. | |
| 2002/0176259 | A1 | 11/2002 | Ducharme | |
| 2003/0011538 | A1 | 1/2003 | Lys et al. | |
| 2003/0028260 | A1 | 2/2003 | Blackwell | |
| 2003/0057884 | A1 | 3/2003 | Dowling et al. | |
| 2003/0057887 | A1 | 3/2003 | Dowling et al. | |
| 2003/0057888 | A1 | 3/2003 | Archenhold et al. | |
| 2003/0076281 | A1 | 4/2003 | Morgan et al. | |
| 2003/0100837 | A1 | 5/2003 | Lys et al. | |
| 2003/0133292 | A1 | 7/2003 | Mueller et al. | |
| 2003/0151917 | A1 | 8/2003 | Daughtry et al. | |
| 2003/0222587 | A1 | 12/2003 | Dowling et al. | |
| 2004/0036006 | A1 | 2/2004 | Dowling | |
| 2004/0052076 | A1 | 3/2004 | Mueller et al. | |
| 2004/0090191 | A1 | 5/2004 | Mueller et al. | |
| 2004/0090787 | A1 | 5/2004 | Dowling et al. | |
| 2004/0105261 | A1 | 6/2004 | Ducharme et al. | |
| 2004/0116039 | A1 | 6/2004 | Mueller et al. | |
| 2004/0130909 | A1 | 7/2004 | Mueller et al. | |
| 2004/0178751 | A1 | 9/2004 | Mueller et al. | |
| 2004/0212320 | A1 | 10/2004 | Dowling et al. | |
| 2004/0212993 | A1 | 10/2004 | Morgan et al. | |
| 2005/0099824 | A1 | 5/2005 | Dowling et al. | |
| 2005/0116667 | A1 | 6/2005 | Mueller et al. | |
| 2005/0151489 | A1 | 7/2005 | Lys et al. | |
| 2005/0213352 | A1 | 9/2005 | Lys et al. | |
| 2005/0213353 | A1 | 9/2005 | Lys | |
| 2005/0218838 | A1 | 10/2005 | Lys | |
| 2005/0218870 | A1 | 10/2005 | Lys | |
| 2005/0219872 | A1 | 10/2005 | Lys | |
| 2005/0231133 | A1 | 10/2005 | Lys | |
| 2005/0236029 | A1 | 10/2005 | Dowling | |
| 2005/0236998 | A1 | 10/2005 | Mueller | |
| 2005/0253533 | A1 | 11/2005 | Lys et al. | |
| 2005/0275626 | A1 | 12/2005 | Mueller | |
| 2005/0276053 | A1 | 12/2005 | Nortrup | |
| 2005/0289279 | A1 | 12/2005 | Fails et al. | |
| 2006/0002110 | A1 | 1/2006 | Dowling | |
| 2006/0012987 | A9 | 1/2006 | Ducharme | |
| 2006/0016960 | A1 | 1/2006 | Morgan | |
| 2006/0022214 | A1 | 2/2006 | Morgan | |
| 2006/0050509 | A9 | 3/2006 | Dowling | |
| 2006/0076908 | A1 | 4/2006 | Morgan | |
| 2006/0098077 | A1 | 5/2006 | Dowling | |
| 2006/0104058 | A1 | 5/2006 | Chemel et al. | |

FOREIGN PATENT DOCUMENTS

| | | | |
|---|---|---|---|
| DE | 29904988 | U1 | 8/1999 |
| DE | 29920603 | U1 | 5/2000 |
| DE | 19948937 | A1 | 4/2001 |
| EP | 53896 | A1 | 6/1982 |
| EP | 1067826 | A2 | 1/2001 |
| GB | 2155708 | A | 9/1985 |
| WO | WO 92/06552 | A | 4/1992 |

* cited by examiner

METHODS AND APPARATUS FOR IMPLEMENTING POWER CYCLE CONTROL OF LIGHTING DEVICES BASED ON NETWORK PROTOCOLS

CROSS-REFERENCE TO RELATED APPLICATIONS

The present application claims the benefit under 35 U.S.C. §119(e) of U.S. Provisional Application Ser. No. 60/687,772, filed Jun. 6, 2005, entitled "Controlled Lighting Methods and Apparatus," which is incorporated herein by reference.

BACKGROUND

A conventional "dimmer" is a device that is used to vary the brightness of light generated by a lighting device. Historically, dimmers have been used perhaps most commonly with incandescent lighting devices, wherein the dimmer is employed to vary the average power provided to the lighting device, and the resulting brightness of light generated by the lighting device varies in relation to the power provided to the lighting device. More specifically, a conventional dimmer typically is coupled to an input signal that provides a source of power (e.g., an A.C. "mains" or line voltage such as 110 VAC or 220 VAC). An output of the dimmer is coupled to the lighting device and may be varied between essentially zero and a maximum value corresponding to the input signal (i.e., between essentially zero and 100% of available power), in response to some user-variable control mechanism associated with the dimmer. By increasing or decreasing the RMS voltage of the dimmer output and hence the mean power provided to the lighting device, it is possible to vary the brightness of the light output between zero (i.e., light off) to full on.

Dimmers range in size from small units having dimensions on the order of a normal light switch used for domestic lighting, to larger high power units used in theatre or architectural lighting installations. Small domestic dimmers generally are directly controlled via some user interface (e.g., a rotary knob or slider potentiometer), although remote control systems for domestic and other uses are available. For example, "X10" is an industry standard communication protocol for home automation applications to facilitate remote/programmed control of a variety of devices including dimmers (X10 was developed by Pico Electronics of Glenrothes, Scotland). X10 primarily uses power line wiring for control signals that involve brief radio frequency bursts representing digital information, wherein the radio frequency bursts are superimposed on the line voltage and used to control various devices coupled to the power line, such as dimmers. In particular, via the X10 communication protocol, an appropriately configured dimmer may be remotely controlled to vary the light output of a lighting device coupled to the dimmer at virtually any level between full off and full on. Using the X10 protocol, multiple dimmers configured to receive X10 control signals may be deployed in a given environment and controlled remotely.

In addition to some domestic and other architectural applications, a number of dimmers also may be employed in entertainment venues (e.g., theaters, concert halls, etc.) to facilitate variable brightness control of several lighting devices (e.g., used to provide stage lighting). Multiple dimmers deployed in such environments (as well as other controllable devices) may be controlled in a networked fashion via a central control interface (sometimes referred to as a control "console") using a communication protocol commonly referred to as DMX512 (often shortened to DMX). In the DMX protocol, dimming instructions are transmitted from the central control interface to multiple dimmers as control data that is formatted into packets including 512 bytes of data, in which each data byte is constituted by 8-bits representing a digital value of between zero and 255. These 512 data bytes are preceded by a "start code" byte. An entire "packet" including 513 bytes (start code plus data) is transmitted serially at 250 kbit/s pursuant to RS-485 voltage levels and cabling practices, wherein the start of a packet is signified by a break of at least 88 microseconds.

In the DMX protocol, each data byte of the 512 bytes in a given packet is intended as a dimming instruction for a particular dimmer, wherein a digital value of zero indicates no power output from the dimmer to the lighting device (i.e., light off), and a digital value of 255 indicates full power output (100% available power) from the dimmer to the lighting device (i.e., light on). Thus, a given communication channel employing the DMX protocol conventionally can support up to 512 addresses DMX dimmers. A given DMX dimmer generally is configured to respond to only one particular data byte of the 512 bytes in the packet, and ignore the other packets, based on a particular position of the desired data byte in the overall sequence of the 512 data bytes in the packet. To this end, conventional DMX dimmers often are equipped with an address selection mechanism that may be manually set by a user/installer to determine the particular position of the data byte that the dimmer responds to in a given DMX packet.

Some examples of commercially available DMX dimmers include the DMX-1 or DMX-4 Dimmer/Relay Packs manufactured by Chauvet of Hollywood, Florida (see www.chauvetlighting.com; the DMX-1 User Manual at www.chauvetlighting.com/system/pdfs/DMX-1_UG.pdf is hereby incorporated herein by reference). These products may be operated to provide gradually variable output power between zero to 100% based on a corresponding input DMX command that may vary between digital values of zero and 255. In one mode of operation, these products may be selected to function as an addressable controllable relay, wherein full power output is provided when the received DMX command exceeds 40% (i.e., a digital value of greater than 102), and zero power is provided for incoming DMX commands less than 40% (i.e., a digital value of less than 102).

In some lighting applications, an Ethernet protocol also may be employed to control various lighting devices, including dimmers. Ethernet is a well-known computer networking technology for local area networks (LANs) that defines wiring and signaling requirements for interconnected devices forming the network, as well as frame formats and protocols for data transmitted over the network. Devices coupled to the network have respective unique addressess, and data for one or more addressable devices on the network is organized as packets. Each Ethernet packet includes a "header" that specifies a destination address (to where the packet is going) and a source address (from where the packet came), followed by a "payload" including several bytes of data (e.g., in Type II Ethernet frame protocol, the payload may be from 46 data bytes to 1500 data bytes). A packet concludes with an error correction code or "checksum." Some dimming control systems involving multiple dimmers may be configured for control via an Ethernet protocol, or include multiple layers of control involving both Ethernet and DMX protocols. Some examples of such systems are provided by Electonic Theatre Controls (ETC) of Middleton, Wis. (see www.etcconnect.com), including model "CEM+" control modules and model "Sensor+" dimmer modules designed to operate based on input control signals formatted according to Ethernet or DMX protocols.

In yet other lighting applications, the Digital Addressable Lighting Interface (DALI) protocol also may be employed to control various lighting devices, including dimmers. The (DALI) protocol has been employed extensively primarily in Europe and Asia to facilitate variable brightness control of multiple fluorescent lighting devices via addressable ballasts coupled together in a network configuration and configured to be responsive to lighting commands formatted according to the DALI protocol. Conventionally, a digital fluorescent lighting network employing a DALI protocol is based on digital 120/277V fluorescent electronic ballasts, typically available in one- and two-lamp models that operate linear T5, T5HO and T8 fluorescent lamps as well as compact fluorescent lamps. DALI-based ballasts and controllable dimmers also are available for high-intensity discharge (HID), incandescent and low-voltage halogen systems.

As with DMX- or Ethernet-based lighting networks, each controllable device in a DALI-based network is given an address so that it can be individually controlled or grouped in multiple configurations. One or more DALI-compatible control device(s) are then coupled to the network of interconnected controllable ballasts/dimmers to control lighting functions across the network. Examples of such DALI-compatible control devices include local wall-mounted controls that enable manual push-button switching to select programmed dimming scenes, a computer for centralized lighting control, local PCs for individual occupant control, as well as occupancy sensors, photosensors and other controls.

In one exemplary implementation, from a central PC configured to communicate with devices pursuant to the DALI protocol, a user/operator (e.g., lighting manager for a facility) can individually address each DALI-based ballast in a building or gang them in groups, then program each ballast or group to dim from 100% to 1% either on a scheduled basis or in reaction to preset conditions, such as available daylight. In another aspect, the DALI-based controllable ballasts/dimmers themselves may provide information back to a control device such as a PC, which information may be used to identify lighting device and/or ballast failure and generate general energy consumption information. Some common examples of DALI-based lighting network deployments include small and open offices where users can control their own lighting, conference rooms and classrooms that require different lighting scenes for multiple types of use, supermarkets and certain retail spaces where merchandising and layout changes frequently, hotel lobbies and meeting spaces to accommodate times of day, events and functions, and restaurants to match the lighting to time of day (breakfast to lunch to dinner). DALI-based components, including controllable ballasts/dimmers, are available from several manufacturers, some examples of which include Advance Transformer, Osram Sylvania (Quicktronic DALI dimming ballasts), Tridonic (DigialDIM and other products), HUNT dimming (Eclipsis PS-D4), Leviton (CD250 DALI Dimming/Scene Controller), and Lightolier Controls (Agili-T network/fixtures).

Yet other lighting applications relating to dimming may provide for dimming and brightness control via proprietary communication protocols other than the DMX, Ethernet or DALI examples discussed above. For example, Lutron Electronics, Inc. (www.lutron.com) provides a variety of systems under the name "GRAFIK Eye®" that implement preset lighting brightness conditions in multiple lighting zones via programmed control of multiple dimmers (see www.lutron.com/grafikeye/). The Lutron GRAFIK Eye® systems typically receive lighting control commands that are formatted according to a proprietry Lutron GRAFIK Eye® protocol, wherein the lighting control commands correspond to various preset lighting brightness conditions in different lighting zones. In one implementation, lighting control commands for the Lutron GRAFIK Eye® systems are generated via a personal computer (PC) running proprietary Windows™ based software. In some implementations, the GRAFIK Eye® systems alternatively may be configured to process lighting control commands that are formatted according to a DMX protocol.

In addition to merely varying the brightness of light generated by a lighting device, some types of lighting devices may be configured to generate different colors of light, wherein both the color and the brightness of light generated at any given time may be varied. One example of a multicolor lighting device based on LED light sources that may be controlled via lighting commands formatted according to a DMX protocol so as to vary the color and/or brightness of generated light is described in U.S. Pat. No. 6,016,038, entitled "Multicolored LED Lighting Method and Apparatus," hereby incorporated herein by reference. In some implementations, such multicolor lighting devices also may be controlled by lighting commands formatted according to an Ethernet protocol; for example, in one implementation, a "translation" device may be employed that receives lighting commands formatted according to an Ethernet protocol from a local area network and translates the Ethernet lighting commands to lighting commands formatted according to a DMX protocol, which are in turn processed by the lighting device so as to control the color and/or brightness of the generated light.

Because the DMX or Ethernet-based multicolor lighting devices described above need to receive both operating power and lighting commands, generally these types of lighting devices require multiple electrical connections (including multiple wires, cables, and/or connectors, or multiple contact/pin connectors) to accommodate the provision of both the operating power and the lighting commands to the lighting device. Accordingly, these types of lighting devices generally cannot be employed in conventional types of lighting sockets (or lighting fixtures including conventional sockets) that provide only operating power to the device (some examples of such conventional sockets include, but are not limited to, incandescent Edison base screw-type sockets, halogen or MR-16 bi-pin sockets, fluorescent sockets, etc.).

However, other types of variable color lighting devices suitable for a variety of applications have been implemented that require only a conventional power source (e.g., an AC line voltage), and accordingly may be configured for use with conventional types of lighting sockets or lighting fixtures equipped with conventional sockets. In one aspect, such lighting devices may be further configured such that a color or other property of light generated by the device may be changed in response to one or more interruptions of power provided to the device. Examples of such lighting devices are described in U.S. Pat. No. 6,967,448, entitled "Methods and Apparatus for Controlling Illumination," hereby incorporated herein by reference. Such lighting devices may be coupled to a source of power via one or more switches that are conventionally employed to turn the lighting device(s) on and off (e.g., a standard wall switch). However, beyond merely turning the lighting device(s) on and off, the switch(es) may be further employed to generate one or more "power cycles," or periodic interruptions of power (e.g., on-off-on power transitions) having particular durations, which in turn affect some aspect of light generated by the lighting device. For purposes of the present disclosure, such lighting devices are referred to accordingly as "power cycle control" lighting devices.

More specifically, in one exemplary implementation, a power cycle control lighting device may include a controller (e.g., a microprocessor) configured to monitor the power provided to the device so as to detect one or more power cycles, in response to which the controller takes some action that affects the generated light. For example, while power is applied to the lighting device, the controller may be particularly configured to detect a power cycle (an on-off-on transition having a predetermined duration) and respond to the power cycle by changing the color and/or some other property of the generated light.

In some implementations, power cycle control lighting devices may be equipped with memory in which is stored one or more pre-programmed lighting control signals, or sequences of lighting control signals constituting lighting programs, that when executed by the lighting device controller provide a variety of possible states for the light generated by the lighting device. For example, one or more particular lighting control signals or programs stored in the memory may dictate a corresponding static color or brightness level of generated light, while other control signals or programs may provide for dynamic multicolor lighting effects. In response to a power cycle, the controller may be configured to select one or more pre-programmed control signals stored in the memory, select and execute a new lighting program from memory, or otherwise affect the light generated by the lighting device. In one exemplary implementation, multiple lighting programs may be stored in the memory, and the controller may be configured to select and execute a new lighting program based on a succession of power cycles. In this manner, a user operating the one or more switches that apply power to the lighting device may sequentially toggle through the available lighting programs by turning the switch from on to off to on again (within a predetermined duration) a number of times until a desired program is selected, at which point the switch may be left in the "on" position to permit execution of the selected lighting program.

SUMMARY

Applicants have recognized and appreciated that a power cycle control lighting device as described above may be employed as a retrofit lighting device in virtually any circumstance involving a conventional light bulb and socket arrangement for delivering power to the light bulb. In this manner, a simple toggle of a light switch used to control the light bulb may be used in the case of the retrofit power cycle control lighting device to generate a variety of different colors of light or color temperatures of white light, as well as preprogrammed dynamic lighting effects.

Applicants have also recognized and appreciated that a variety of controllable dimmers or relays which may be controlled via any of a variety of network communication protocols to provide variable output power (e.g., from zero to 100% available power) or switched output power to lighting devices may be particularly operated via appropriate commands to provide power cycles, or interruptions in power constituting relatively quick transitions between 100% and zero power (rather than gradual increases or decreases in output power in the case of conventionally operated controllable dimmers).

In view of the foregoing, various embodiments of the present disclosure are directed to methods and apparatus for implementing power cycle control of lighting devices based on network communication protocols. For example, in one embodiment, a controllable dimmer or controllable relay is employed together with a power cycle control lighting device, wherein the controllable dimmer/relay serves as a network command interface for the power cycle control lighting device.

In one embodiment, a controllable dimmer is particularly controlled by lighting commands formatted according to any of a variety of communications protocols, which instruct the controllable dimmer to output one or more power cycles, rather than gradual increases or decreases in power, to the power cycle control lighting device. In essence, the controllable dimmer is operated as a controllable relay. In response to the power cycle(s) output by the controllable dimmer or controllable relay, the power cycle control lighting device may alter some aspect of the generated light (e.g., change one or more of color, color temperature, overall brightness, dynamic effect, etc.). In this manner, a power cycle control lighting device may be made responsive, via the controllable dimmer/relay, to lighting control commands formatted according to any of a variety of industry standard (e.g., DMX, Ethernet, DALI, X10) or proprietary protocols. Accordingly, in one aspect, network controllability is afforded to a power cycle control lighting device, which may be easily retrofitted into a conventional socket (or non-conventional socket) that provides only operating power to the lighting device.

As discussed in greater detail below, one embodiment of the present disclosure is directed to an apparatus, comprising at least one lighting unit configured to generate variable color or variable color temperature radiation based at least in part on at least one interruption of power supplied to the at least one lighting unit, and one of a controllable dimmer and a controllable relay coupled to the at least one lighting unit and configured to generate the at least one interruption of power in response to at least one control signal.

Another embodiment is directed to a method, comprising acts of: A) generating variable color or variable color temperature radiation based at least in part on at least one interruption of power; and B) generating the at least one interruption of power in response to at least one control signal formatted according to a network communication protocol.

Another embodiment is directed to an apparatus, comprising at least one lighting unit including a processor and a memory having a plurality of lighting programs stored therein. The at least one lighting unit is configured to select and execute a particular lighting program of the plurality of programs based at least in part on at least one interruption of power supplied to the at least one lighting unit. The apparatus further comprises at least one of a controllable dimmer and a controllable relay coupled to the at least one lighting unit and configured to generate the at least one interruption of power in response to at least one control signal.

Another embodiment is directed to a method, comprising acts of: A) executing a particular lighting program of a plurality of lighting programs based at least in part on at least one interruption of power; and B) generating the at least one interruption of power in response to at least one control signal formatted according to a network communication protocol.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, a controllable dimmer or controllable relay associated with a lighting unit, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

DETAILED DESCRIPTION

Various embodiments of the present disclosure are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Figure 1:
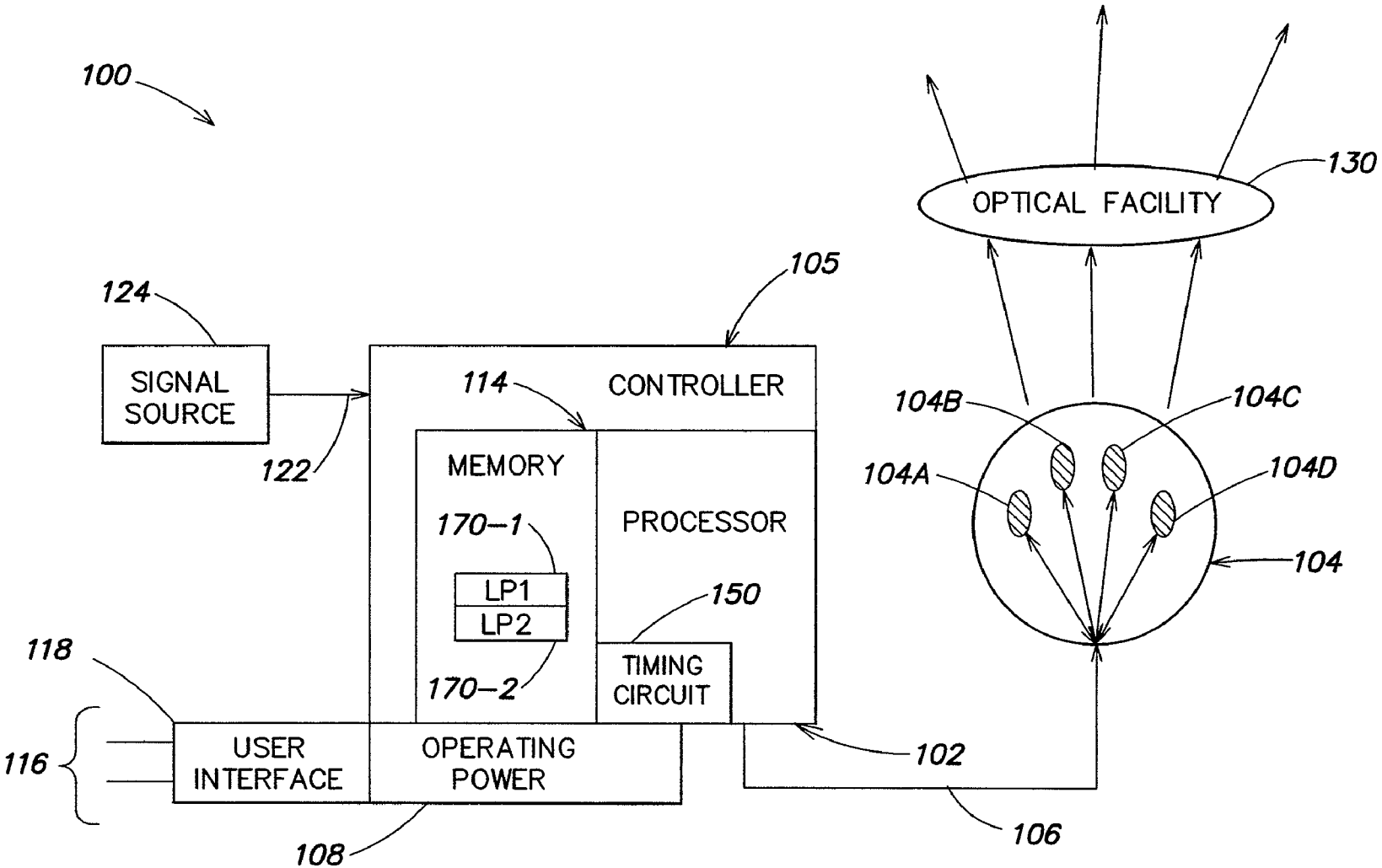
FIG. 1 illustrates an example of a power cycle control lighting unit that may be used in combination with a controllable dimmer or relay, according to one embodiment of the present disclosure.

FIG. 1 illustrates one example of a power cycle control lighting unit 100 that may be used in combination with a controllable dimmer or relay, according to one embodiment of the present disclosure. Some general examples of LED-based lighting units similar to those that are described below in connection with FIG. 1 may be found, for example, in U.S. Pat. No. 6,967,448, issued Nov. 22, 2005 to Morgan et al., entitled "Methods and Apparatus for Controlling Illumination," which patent is hereby incorporated herein by reference.

In various embodiments of the present disclosure, the lighting unit 100 shown in FIG. 1 may be used alone or together with other similar lighting units in a system of lighting units (e.g., as discussed further below in connection with FIG. 2). Used alone or in combination with other lighting units, the lighting unit 100 may be employed in a variety of applications including, but not limited to, interior or exterior space (e.g., architectural) lighting and illumination in general, direct or indirect illumination of objects or spaces, theatrical or other entertainment-based/special effects lighting, decorative lighting, safety-oriented lighting, illumination of liquids such as in pools and spas, and lighting associated with, or illumination of, displays and/or merchandise (e.g. for advertising and/or in retail/consumer environments).

Additionally, one or more lighting units similar to that described in connection with FIG. 1 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

In one embodiment, the lighting unit 100 shown in FIG. 1 may include one or more light sources 104A, 104B, 104C, and 104D (shown collectively as 104), wherein one or more of the light sources may be an LED-based light source that includes one or more light emitting diodes (LEDs). In one aspect of this embodiment, any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 1, the lighting unit 100 also may include a controller 105 that is configured to output one or more control signals 106 to drive the light sources so as to generate various brightness levels (intensities) of light from the light sources. For example, in one implementation, the controller 105 may be configured to output at least one control signal for each light source so as to independently control the brightness or intensity of light (e.g., radiant power in lumens) generated by each light source; alternatively, the controller 105 may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the controller 105 may control other dedicated circuitry (not shown in FIG. 1) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 1, controlled by the controller 105. While the voltage $V_{source}$ is applied across the light source, a predetermined fixed current $I_{source}$ (e.g., determined by a current regulator, also not shown in FIG. 1) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the controller 105 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller 105 may be configured to vary the operating powers for one or more channels. By varying operating powers for different channels, different perceived colors and brightness levels of light may be generated by the lighting unit.

In one embodiment of the lighting unit 100, as mentioned above, one or more of the light sources 104A, 104B, 104C, and 104D shown in FIG. 1 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 1, the lighting unit 100 may be constructed and arranged to produce a wide range of variable color radiation. For example, in one embodiment, the lighting unit 100 may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals 106 output by the controller 105). Furthermore, the controller 105 may be particularly configured to provide control signals to one or more of the light sources so as to generate a variety of static or time-varying (dynamic) multi-color (or multi-color temperature) lighting effects. To this end, in one embodiment, the controller may include a processor 102 (e.g., a microprocessor) programmed to provide such control signals to one or more of the light sources. In one aspect discussed further below, the processor 102 may be programmed to provide such control signals in response to one or more interruptions in the power, or "power cycles," applied to the lighting unit.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Additionally, multiple white LEDs having different color temperatures (e.g., one or more first white LEDs that generate a first spectrum corresponding to a first color temperature, and one or more second white LEDs that generate a second spectrum corresponding to a second color temperature different than the first color temperature) may be employed, in an all-white LED lighting unit or in combination with other colors of LEDs. Such combinations of differently colored LEDs and/or different color temperature white LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

In one embodiment, the lighting unit 100 shown in FIG. 1 also may include one or more optical elements 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As shown in FIG. 1, the lighting unit 100 also may include a memory 114 to store various information. For example, the memory 114 may be employed to store one or more lighting commands or programs for execution by the processor 102 (e.g., to generate one or more control signals for the light sources), as well as various types of data useful for generating variable color radiation (e.g., calibration information). FIG. 1 depicts two lighting programs 170-1 and 170-2 (LP1 and LP2) stored in the memory 114 for purposes of illustration, although it should be appreciated that virtually any number of lighting programs may be stored in the memory. The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

In another aspect, as also shown in FIG. 1, the lighting unit 100 optionally may include or otherwise be associated with one or more user interfaces 118 that are provided to facilitate any of a number of user-selectable settings or functions (e.g., generally controlling the light output of the lighting unit 100, changing and/or selecting various pre-programmed lighting programs that when executed cause various lighting effects to be generated by the lighting unit, changing and/or selecting various parameters of selected lighting programs, setting particular identifiers such as addresses or serial numbers for the lighting unit, etc.).

In one implementation, the user interface 118 may constitute one or more switches (e.g., a standard wall switch) that are coupled to an AC line voltage 160 as a source of power, which switch(es) is/are toggled to provide operating power 108 to the controller 105. In one aspect of this implementation, the controller 105 is configured to monitor the operating power 108 as controlled by the user interface 118, and in turn control one or more of the light sources based at least in part on a duration of a power interruption or "power cycle" caused by operation of the user interface. As discussed above, the controller may be particularly configured to respond to a predetermined duration of a power interruption by, for example, selecting one or more pre-programmed control signals stored in memory, modifying control signals generated by executing one or more lighting programs 170-1 or 170-2, selecting and executing a new lighting program from memory, or otherwise affecting the light generated by one or more of the light sources.

In one aspect of a power cycle control implementation, the controller 105 may be configured to control the light sources 104 based on one or more interruptions in the operating power 108 having an interruption duration that is less than or equal to a predetermined duration. In another aspect of this embodiment, if the interruption duration of an interruption in the power 108 is greater than the predetermined duration, the controller 105 does not effect any changes in the radiation output by the light sources 104. More specifically, according to one embodiment, the controller 105 may include a timing circuit 150 that monitors operating power 108, wherein the processor 102 is configured to provide one or more control signals 106 to the light sources 104 based on the monitored power 108. In another aspect, the timing circuit 150 may include an RC circuit (not shown explicitly in FIG. 1) having one or more capacitors that maintain a charge based on the application of the power 108 to the timing circuit 150. In this aspect, a time constant of the RC circuit may be particularly selected based on a desired predetermined duration of an interruption in the power 108 that causes the controller 105 (e.g., via the processor 102) to effect some change in the light output by the light sources 104.

For example, according to one aspect of this embodiment, the controller may be adapted to modify one or more variable parameters of one or more lighting programs 170-1 or 170-2 based on one or more interruptions in the power 108 having less than or equal to the predetermined duration. Alternatively, in another aspect of this embodiment, if a number of lighting programs are stored in the memory 114, the controller 105 may be adapted to select and execute a particular lighting program based on one or more interruptions in the power 108 having less than or equal to the predetermined duration.

In particular, the controller 105 may be configured to select and execute different lighting programs stored in the memory 114 based on successive interruptions in the power 108 (i.e., successive power cycles). In this aspect, each lighting program stored in the memory may be associated with one identifier in a sequence of identifiers (e.g., program 1, program 2, program 3, etc.). The controller 105 may be adapted to sequentially select and execute a different lighting program, based on the sequence of identifiers assigned to the programs, by toggling through the different lighting programs with each successive power cycle having a duration of less than or equal to the predetermined duration. Furthermore, according to another aspect of this embodiment, if a power cycle is greater than the predetermined duration, the controller 105 may be configured not to select and execute a different lighting program, but rather execute (or continue executing) the last lighting program selected before the power cycle that was greater than the predetermined duration (i.e., the lighting program selection does not change on a power-up following interruption in the power signal of a significant duration).

More specifically, in one exemplary implementation of the embodiment shown in FIG. 1, upon power-up, the processor 102 periodically monitors the timing circuit 150. If the processor detects a logic high value output by the timing circuit 150 (i.e., the most recent power cycle was less than the predetermined duration, such that an RC circuit of the timing circuit 150 remained "charged-up"), the processor selects a new lighting program from the memory 114. However, if the processor 102 detects a logic low value output by the timing circuit 150 (i.e., the most recent power cycle was greater than the predetermined duration, such that an RC circuit of the timing circuit 150 was able to significantly discharge), the processor does not select a new lighting program, but rather executes the lighting program that was selected prior to the most recent power cycle.

Upon execution by the processor 102, a given lighting program may be configured to generate any of a variety of possible lighting states from the lighting unit 100. For example, multiple lighting programs may be stored in the memory 114 that, when executed, generate respective static states of different light colors as well as different color temperatures of white light (e.g., program 1—purple light; program 2—warm white; program 3—cool white; program 4—sky blue, etc.). Additionally, one or more lighting programs may be stored in the memory 114 that, when executed, generate one or more dynamic (time-varying) lighting effects (e.g., flashing a single color at some predetermined rate, cycling through multiple colors at some predetermined rate, toggling between two or more colors at some predetermined rate, etc.).

Additionally, sensor-responsiveness may be integrated into a given lighting program; for example, a lighting program stored in the memory 114 may be configured such that, when executed, some detectable condition is monitored (e.g., via one or more sensors coupled to the controller 105) and one or more states of light are generated based at least in part on the monitored detectable condition. For example, a lighting program may be configured such that a brightness level and/or spectral content of ambient light in proximity to the lighting unit is monitored, and one or more of the color, color temperature, and brightness of the light generated by the lighting unit is determined or varied based at least in part on the monitored parameter(s) of the ambient light.

To this end, the lighting unit 100 of FIG. 1 may include any of a variety of signal sources 124 in the form of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like. Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics.

While not shown explicitly in FIG. 1, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like. A given lighting unit also may have any one of a variety of mounting arrangements for the light source(s), enclosure/housing arrangements and shapes to partially or fully enclose the light sources, and/or electrical and mechanical connection configurations. In particular, in some implementations, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.). Additionally, one or more optical elements as discussed above may be partially or fully integrated with an enclosure/housing arrangement for the lighting unit.

Figure 2:
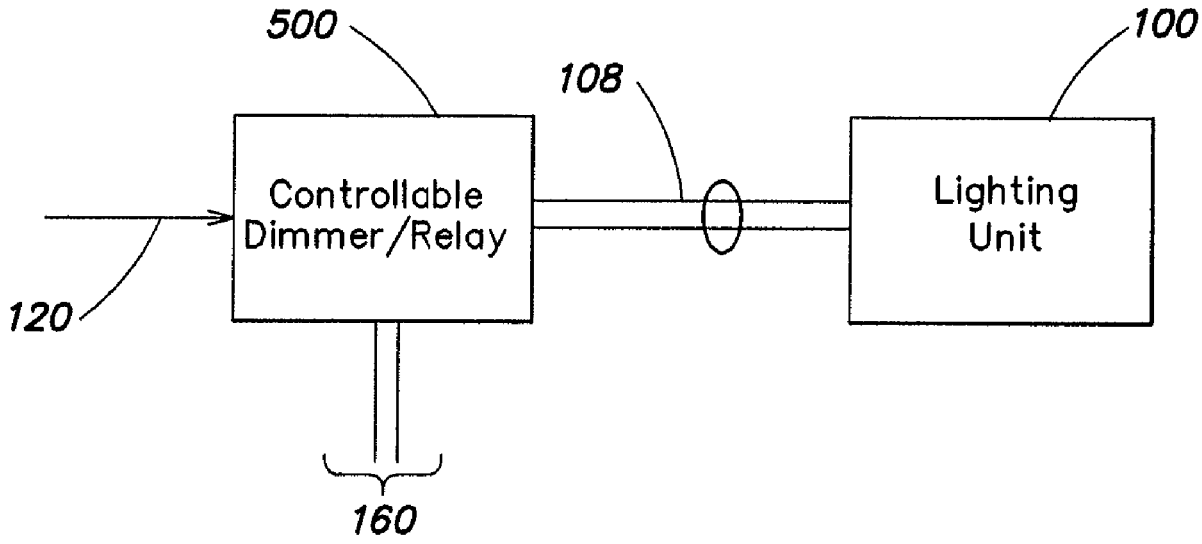
FIG. 2 is a diagram illustrating an apparatus including a power cycle control lighting unit similar to that discussed above in connection with FIG. 1, in combination with a controllable dimmer/relay, according to one embodiment of the disclosure.

FIG. 2 is a diagram illustrating an apparatus according to one embodiment of the disclosure that comprises a power cycle control lighting unit 100 similar to that discussed above in connection with FIG. 1, in combination with a controllable dimmer/relay 500. In particular, the lighting unit 100 is configured to generate variable color or variable color temperature radiation based at least in part on one or more interruptions of the power 108 supplied to the lighting unit. As shown in FIG. 2, the controllable dimmer/relay 500 provides as an output the power 108 for the lighting unit 100 and receives as an input the line voltage 160 as a source of power. The controllable dimmer/relay 500 also receives as an input at least one electrical control signal 120, in response to which the controllable dimmer/relay 500 generates the one or more interruptions of power. While FIG. 2 illustrates one lighting unit 100 coupled to the controllable dimmer/relay 500, it should be appreciated that the disclosure is not limited in this respect, as a given controllable dimmer/relay may be configured with an appropriate power rating to provide operating power 108 to multiple power cycle control lighting units 100.

In one aspect, as discussed above in connection with FIG. 1, the lighting unit 100 may be configured to generate the variable color or variable color temperature radiation based on one or more interruptions in the operating power 108 (i.e., one or more power cycles) having an duration that is less than or equal to a predetermined duration. In another aspect of this embodiment, if the duration of power cycle is greater than the predetermined duration, the lighting unit does not vary the generated radiation. In response to power cycle(s) of an appropriate duration output by the controllable dimmer/relay 500, the power cycle control lighting unit 100 may be configured to alter various aspects of the generated light (e.g., change one or more of color, color temperature, overall brightness, dynamic effect, etc.). As discussed above in connection with FIG. 1, in some implementations, changes in the generated light may be accomplished via selection and execution of different lighting programs stored in the lighting unit 100 in response to one or more power cycles.

In yet another aspect, the controllable dimmer/relay 500 serves as a network command interface for the power cycle control lighting unit 100. For example, in various implementations, the controllable dimmer/relay 500 is particularly configured as an addressable network device that is controlled by one or more control signals 120 in the form of lighting commands formatted according to any of a variety of communications protocols. In this manner, the power cycle control lighting unit 100 may be made responsive, via the controllable dimmer/relay 500, to lighting control commands formatted according to any of a variety of industry standard (e.g., DMX, Ethernet, DALI, X10) or proprietary protocols. Accordingly, in yet another aspect, network controllability is afforded to a power cycle control lighting unit, which may be easily retrofitted into a conventional socket (or non-conventional socket) that provides only the operating power 108 to the lighting unit.

In various implementations, the controllable dimmer/relay 500 may be particularly designed as a controllable relay (also referred to as a controllable switch), wherein there are only two possible states for the operating power 108 provided as an output to the lighting unit 100; namely, zero power or 100% power based on the available line voltage 160. In one aspect of such an implementation, the controllable relay may be responsive to control signals 120 corresponding to only two different lighting commands; namely, a first command representing zero output power and a second command representing 100% output power. In another aspect, the timing with which these respective first and second lighting commands are received by the controllable relay may in turn determine whether or not a resulting power cycle of the power 108 has a suitable duration for effecting a change in the light generated by the lighting unit 100. In another implementation, a controllable relay may be configured to receive a single lighting command requesting the output of a power cycle, and generate the power cycle having an appropriate duration for effecting some change in the light generated by the lighting unit. In this manner, the timing of lighting commands received by the controllable relay may not necessarily affect the duration of power cycles generated by the controllable relay.

In yet another implementation, the controllable dimmer/relay 500 may be particularly designed as a controllable dimmer, wherein the operating power 108 provided as an output to the lighting unit 100 may be varied between zero and 100% based on a corresponding value represented by a given control signal 120. Stated differently, the controllable dimmer may be responsive to control signals having a variety of values representing intermediate output powers between zero and 100%. In one aspect of this implementation, to ensure appropriate operation in combination with the power cycle control lighting unit 100, the control signals 120 sent to the controllable dimmer accordingly should be limited to only two different lighting commands (e.g., representing the extreme possibilities); namely, a first command representing zero output power and a second command representing essentially 100% output power (without any other commands representing intermediate powers being sent to the controllable dimmer). In this manner, the controllable dimmer may be instructed to output one or more power cycles, rather than gradual increases or decreases in output power (in essence, the controllable dimmer is operated as a controllable relay). As in the case with the controllable relay implementation described above, in another aspect the timing with which these respective first and second lighting commands are received by the controllable dimmer should be such that the resulting power cycle of the power 108 has a suitable duration for effecting a change in the light generated by the lighting unit 100.

In yet another implementation, a controllable dimmer/relay 500 designed primarily as a controllable dimmer may be particularly configured to accept incoming lighting commands representing output powers throughout the range from zero to 100% and process the incoming lighting commands according to some predetermined threshold, such that commands above the threshold cause a full power output and commands below the threshold cause a zero power output. In this manner, the controllable dimmer is configured to function a controllable relay, notwithstanding the full range of possible lighting commands that it might receive. For example, a predetermined threshold may be set at 40%, such that full output power is provided when received lighting commands represent values that exceed 40% and zero power is provided for incoming commands representing values less than 40%.

Some examples of a controllable dimmer/relay 500 suitable for use in connection with the power cycle control lighting unit 100 shown in FIG. 2 include, but are not limited to, DMX controllable dimmers/relays available from Chauvet of Hollywood, Fla. (e.g., the DMX-1 or DMX-4 dimmer/relay packs, see www.chauvetlighting.com), various DMX and/or Ethernet controllable products available from Electonic Theatre Controls (ETC) of Middleton, Wis. (e.g., the model "CEM+" control modules and model "Sensor+" dimmer modules designed to operate based on input control signals or lighting commands formatted according to Ethernet or DMX protocols, see www.etcconnect.com), DALI-based controllable dimmers available from a number of manufacturers, and other controllable dimming products based on proprietary protocols, such as the GRAFIK Eye® line of dimming products available from Lutron, Incorporated (see www.lutron.com).

For example, in one embodiment, the interruption of power ("power cycle") feature discussed above may be combined with DMX control. In particular, a DMX-based controllable dimmer/relay 500 may be configured to provide one or more power cycles (i.e., power on/off control signals) to a lighting unit 100 in response to the receipt of particular instructions formatted in a DMX protocol (e.g., an 8-bit digital value within a frame of 512 data bytes, wherein a digital value of zero represents power off, and a digital value of 255 represents full power on).

Figure 3:
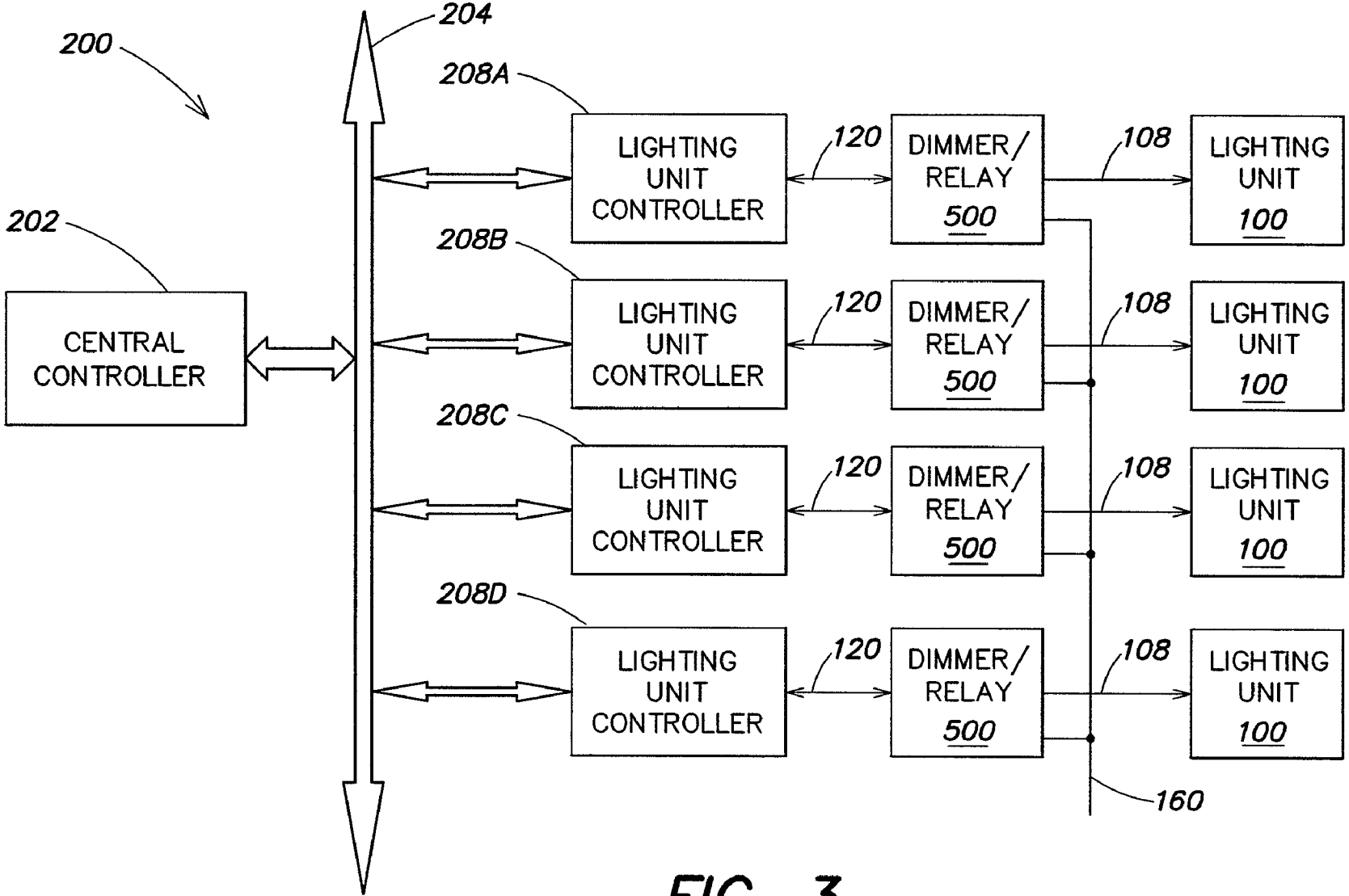
FIG. 3 is a diagram illustrating a networked lighting system, according to one embodiment of the disclosure, that employs the controllable dimmer/relay—power cycle control lighting unit combination shown in FIG. 2.

FIG. 3 is a diagram illustrating a networked lighting system, according to one embodiment of the disclosure, that employs the controllable dimmer/relay—power cycle control lighting unit combination shown in FIG. 2. In the embodiment of FIG. 3, a number of controllable dimmers/relays 500 and lighting units 100, similar to those discussed above in connection with FIGS. 1 and 2, are coupled together to form the networked lighting system. It should be appreciated, however, that the particular configuration and arrangement of controllable dimmers/relays and lighting units shown in FIG. 3 primarily is for purposes of illustration, and that the disclosure is not limited to the particular system topology shown in FIG. 3.

As shown in the embodiment of FIG. 3, the lighting system 200 may include one or more lighting unit controllers (hereinafter "LUCs") 208A, 208B, 208C, and 208D, wherein each LUC is responsible for communicating with and generally controlling one or more controllable dimmers/relays 500 coupled to it via the control signals 120. Although FIG. 3 illustrates one controllable dimmer/relay coupled to each LUC, it should be appreciated that the disclosure is not limited in this respect, as different numbers of controllable dimmers/relays 500 may be coupled to a given LUC in a variety of different configurations (serially connections, parallel connections, combinations of serial and parallel connections, etc.) using a variety of different communication media and protocols for the control signals 120. Additionally, while FIG. 3 illustrates one lighting unit 100 coupled to each controllable dimmer/relay, is should be appreciated that the disclosure is not limited in this respect, as a given controllable dimmer/relay may be configured to provide power to multiple lighting units 100.

In the system of FIG. 3, each LUC in turn may be coupled to a central controller 202 that is configured to communicate with one or more LUCs. Although FIG. 3 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of controllable dimmers/relays to respective LUCs, may be accomplished in different manners (e.g., using different configurations, communication media, and protocols).

For example, according to one embodiment of the present disclosure, the central controller 202 shown in FIG. 3 may by configured to implement Ethernet-based communications with the LUCs, and in turn the LUCs may be configured to implement DMX-based communications with the controllable dimmers/relays 500 (i.e., the control signals 120 represent lighting commands formatted according to a DMX protocol). In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more controllable dimmers/relays coupled to it, for example, via a DMX protocol, based on the Ethernet communications with the central controller 202. In one aspect, one or more controllable dimmers/relays coupled to a given LUC would have appropriate addresses selected so as to receive a particular data byte of the 512 data bytes typically present in a DMX packet.

More specifically, according to one embodiment, the LUCs 208A, 208B, and 208C shown in FIG. 3 may be configured to be "intelligent" in that the central controller 202 may be configured to communicate higher level commands to the LUCs that need to be interpreted by the LUCs before lighting control information can be forwarded to the controllable dimmers/relays 500 as the control signals 120. For example, a lighting system operator may want to generate a color changing effect in each lighting unit coupled to a given controllable dimmer/relay so as to generate the appearance of an evolving rainbow of colors (e.g., time varying change of colors throughout the visible spectrum). In this example, the operator may provide a simple instruction to the central controller 202 to accomplish this, and in turn the central controller may communicate to one or more LUCs using an Ethernet-based protocol high level command to generate a "rainbow." When a given LUC receives such a command, it may then interpret the command and communicate further commands to one or more controllable dimmers/relays using a DMX protocol for the control signals 120, based on knowledge of a particular stored program in the lighting units that, when selected and executed, generates the rainbow effect. Accordingly, the control signals 120 issued to the DMX controllable dimmers/relays result in an appropriate number/sequence of power cycles output by the controllable dimmer/relays, such that the program representing the rainbow effect is selected and executed in the lighting units.

It should again be appreciated that the foregoing example of using multiple different communication implementations/protocols (e.g., Ethernet/DMX) in a lighting system according to one embodiment of the present disclosure is for purposes of illustration only, and that the disclosure is not limited to this particular example.

One issue that may arise in implementations in which multiple power cycle controlled lighting units are coupled to the same controllable dimmer/relay relates to synchronization amongst the lighting units. This issue is discussed in U.S. Pat. No. 6,801,003, issued Oct. 5, 2004 to Dowling et al., and entitled "Systems and Methods for Synchronizing Lighting Effects," which patent is hereby incorporated herein by reference. For example, it may be desirable to select and execute an identical lighting program in each of multiple lighting units coupled to the same dimmer that generates the same dynamic (time-varying) lighting effect from each lighting unit. Upon initial selection of the lighting program essentially simultaneously in each of the lighting units (e.g., by one or more power cycles provided identically and essentially simultaneously to all of the lighting units) and subsequent execution of the program, the generation of the lighting effect indeed may appear synchronized amongst the lighting units at least initially. However, over time, the lighting effects generated by the respective lighting units may gradually become out of phase with one another and may no longer be synchronous. This may be due to slight variations over time, or drift, in the timing elements common to the respective processors/controllers of the lighting units (which may be subject to variation because of differences to due manufacturing processes, temperature changes, etc.). This process of drifting out of phase, while perhaps slow in some cases, ultimately may become visibly observable in the respective lighting effects.

In view of the foregoing, according to yet another embodiment, with reference again to FIG. 1, the controller 105 of the lighting unit 100 may be configured to monitor the operating power 108 provided by a controllable dimmer/relay and synchronize the execution of a given selected lighting program (and hence the corresponding generated lighting effect) with a parameter of the operating power. For example, in one aspect, the processor 102 may be configured so as coordinate the timing of execution of the lighting program with the frequency of the signal providing the operating power 108 (an A.C. line voltage). In other aspects, the processor 102 may be configured so as to coordinate the execution of the lighting program with a transient parameter of the operating power 108 or other randomly, periodically or otherwise occurring parameter of the power 108 (e.g., a zero-crossing of the A.C. line voltage). In this manner, the respective lighting effects generated by multiple lighting units coupled to the same operating power (i.e., the output of the same controllable dimmer/relay) may be synchronized.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. An apparatus, comprising:

at least one lighting unit configured to generate variable color or variable color temperature radiation based at least in part on at least one interruption of power supplied to the at least one lighting unit; and one of a controllable dimmer and a controllable relay coupled to the at least one lighting unit and configured to generate the at least one interruption of power in response to at least one control signal, wherein the at least one lighting unit is configured to control at least one property of the variable color or variable color temperature radiation based on the at least one interruption in the power having a duration that is less than or equal to a predetermined duration.

2. The apparatus of claim 1, wherein the at least one lighting unit includes at least one LED.

3. The apparatus of claim 2, wherein the at least one LED includes at least one white LED.

4. The apparatus of claim 2, wherein the at least one LED includes: at least one first LED configured to generate first radiation having a first spectrum; and at least one second LED configured to generate second radiation having a second spectrum different than the first spectrum.

5. The apparatus of claim 4, wherein: the at least one first LED includes at least one first white LED; and the at least one second LED includes at least one second white LED.

6. The apparatus of claim 1, wherein the at least one control signal is formatted according to a network communications protocol.

7. The apparatus of claim 1, wherein the at least one control signal is formatted according to a DMX protocol.

8. The apparatus of claim 1, wherein the at least one control signal is formatted according to an Ethernet protocol.

9. The apparatus of claim 1, wherein the at least one control signal is formatted according to a DALI protocol.

10. The apparatus of claim 1, wherein the one of the controllable dimmer and the controllable relay includes the controllable relay.

11. The apparatus of claim 1, wherein the one of the controllable dimmer and the controllable relay includes the controllable dimmer.

12. The apparatus of claim 11, wherein the at least one control signal includes only a first type of control signal in response to which the controllable dimmer outputs zero power and a second type of control signal in response to which the controllable dimmer outputs essentially full power.

13. The apparatus of claim 12, wherein the first and second types of control signals are formatted according to a DMX protocol.

14. The apparatus of claim 12, wherein the first and second types of control signals are formatted according to an Ethernet protocol.

15. The apparatus of claim 12, wherein the first and second types of control signals are formatted according to a DALI protocol.

16. The apparatus of claim 1, wherein the at least one lighting unit is configured such that the at least one property of the variable color or variable color temperature radiation is not changed if the duration of the at least one interruption in the power is greater than the predetermined duration.

17. The apparatus of claim 1, wherein the at least one lighting apparatus comprises: at least one memory to store at least one lighting program; and at least one processor configured to execute the at least one lighting program, based on the at least one interruption in the power, so as to control the variable color or variable color temperature radiation.

18. The apparatus of claim 17, wherein the at least one lighting program includes a plurality of lighting programs, wherein the at least one memory stores the plurality of lighting programs, and wherein the at least one lighting unit is configured to select and execute a particular lighting program of the plurality of lighting programs based on the at least one interruption in the power.

19. The apparatus of claim 18, wherein the at least one interruption includes a plurality of interruptions, and wherein the at least one lighting unit is configured to select and execute different lighting programs of the plurality of lighting programs based on successive interruptions of the plurality of interruptions.

20. The apparatus of claim 19, wherein each interruption of the plurality of interruptions has a corresponding duration, and wherein the at least one lighting unit is configured to select and execute a different lighting program of the plurality of lighting programs if the corresponding duration of at least one interruption is less than or equal to a predetermined duration.

21. The apparatus of claim 19, wherein each lighting program of the plurality of lighting programs is associated with one identifier in a sequence of identifiers, and wherein the at least one lighting unit is configured to sequentially select and execute the different lighting programs based on the sequence of identifiers and the successive interruptions.

22. A method, comprising acts of:

A) generating variable color or variable color temperature radiation based at least in part on at least one interruption of power;

B) generating the at least one interruption of power in response to at least one control signal formatted according to a network communication protocol; and C) controlling at least one property of the variable color or variable color temperature radiation based on the at least one interruption in the power having a duration that is less than or equal to a predetermined duration.

23. The method of claim 22, wherein the at least one control signal is formatted according to a DMX protocol.

24. The method of claim 22, wherein the at least one control signal is formatted according to an Ethernet protocol.

25. The method of claim 22, wherein the at least one control signal is formatted according to a DALI protocol.

26. An apparatus, comprising:

at least one lighting unit including a processor and a memory having a plurality of lighting programs stored therein, the at least one lighting unit being configured to select and execute a particular lighting program of the plurality of programs based at least in part on at least one interruption of power supplied to the at least one lighting unit; and a controllable dimmer coupled to the at least one lighting unit and configured to generate the at least one interruption of power in response to at least one control signal, wherein the at least one control signal includes only a first type of control signal in response to which the controllable dimmer outputs zero power and a second type of control signal in response to which the controllable dimmer outputs essentially full power.

27. The apparatus of claim 26, wherein at least one lighting program of the plurality of lighting programs, when executed, causes the lighting unit to generate light having a static non-white color.

28. The apparatus of claim 26, wherein at least one lighting program of the plurality of lighting programs, when executed, causes the lighting unit to generate essentially white light.

29. The apparatus of claim 26, wherein at least a first lighting program of the plurality of lighting programs, when executed, causes the lighting unit to generate first white light having a first color temperature.

30. The apparatus of claim 29, wherein at least a second lighting program of the plurality of lighting programs, when executed, causes the lighting unit to generate second white light having a second color temperature different than the first color temperature.

31. The apparatus of claim 26, wherein at least one lighting program of the plurality of lighting programs, when executed, causes the lighting unit to generate a dynamic lighting effect.

32. The apparatus of claim 26, wherein at least one lighting program of the plurality of lighting programs, when executed, causes the lighting unit to generate light having at least one property based at least in part on a monitored detectable condition.

33. The apparatus of claim 32, wherein the monitored detectable condition includes at least one of a brightness and a spectral content of ambient light in proximity to the at least one lighting unit.

* * * * *